US009366444B2

(12) United States Patent
Salunkhe et al.

(10) Patent No.: US 9,366,444 B2
(45) Date of Patent: Jun. 14, 2016

(54) FLEXIBLE COMPONENT PROVIDING SEALING CONNECTION

(71) Applicants: Anil L. Salunkhe, Charlotte, NC (US); Dustin C. Boudin, Charlotte, NC (US)

(72) Inventors: Anil L. Salunkhe, Charlotte, NC (US); Dustin C. Boudin, Charlotte, NC (US)

(73) Assignee: SIEMENS ENERGY, INC., Orlando, FL (US)

( * ) Notice: Subject to any disclaimer, the term of this patent is extended or adjusted under 35 U.S.C. 154(b) by 331 days.

(21) Appl. No.: 14/077,594

(22) Filed: Nov. 12, 2013

(65) Prior Publication Data

US 2015/0128610 A1 May 14, 2015

(51) Int. Cl.
*F23R 3/42* (2006.01)
*F01D 9/02* (2006.01)

(52) U.S. Cl.
CPC . *F23R 3/42* (2013.01); *F01D 9/023* (2013.01); *F05D 2240/55* (2013.01); *F05D 2240/57* (2013.01); *F23R 2900/00012* (2013.01)

(58) Field of Classification Search
CPC .. F23R 3/42; F23R 2900/00012; F01D 9/023; F05D 2240/55; F05D 2240/57
USPC ..... 60/800, 796, 797, 799, 752
See application file for complete search history.

(56) References Cited

U.S. PATENT DOCUMENTS 4,645,217 A * 2/1987 Honeycutt, Jr. ..... F01D 11/005 277/555
4,785,623 A 11/1988 Reynolds
5,400,586 A 3/1995 Bagepalli et al.
5,474,306 A 12/1995 Bagepalli et al.
6,450,762 B1 9/2002 Munshi
6,464,457 B1 * 10/2002 Morgan ..... F01D 11/005 277/630
6,547,257 B2 4/2003 Cromer
6,588,214 B2 7/2003 Mack et al.
6,675,584 B1 1/2004 Hollis et al.
6,834,507 B2 12/2004 Jorgensen
7,246,995 B2 * 7/2007 Zborovsky ..... F01D 9/23 415/137
7,527,469 B2 5/2009 Zborovsky et al.
7,584,620 B2 9/2009 Weaver et al.
7,784,264 B2 8/2010 Weaver et al.
2002/0121744 A1 9/2002 Aksit et al.
2002/0163134 A1 11/2002 Cromer
2005/0241314 A1 * 11/2005 Takaya ..... F01D 9/023 60/752
2008/0179837 A1 7/2008 Ryan
2012/0292860 A1 11/2012 Moehrle

FOREIGN PATENT DOCUMENTS

EP 2532837 A2 12/2012
WO 0227148 A1 4/2002

* cited by examiner

*Primary Examiner* — Steven Sutherland

(57) ABSTRACT

A sealing component (61) for a turbine (15) positionable at an interface between a transition section (21) for carrying exhaust gas and a turbine inlet section (32). A U-shaped section (45) includes first and second legs (67, 69). When the sealing component is positioned at the interface, the legs extend about the turbine axis. A seal flange (75) connects to the U-shaped section. The positioned sealing component extends about the axis and in a direction away from the first leg. The seal flange faces the inner surface (76) of the flange. A flexible strip (79), positioned radially outward with respect to the seal flange, extends about the axis and extends along the axis between the U-shaped section and the flange. The flexible strip acts as a spring member pressing against the outer surface (96) of the flange.

16 Claims, 6 Drawing Sheets

FLEXIBLE COMPONENT PROVIDING SEALING CONNECTION

FIELD OF THE INVENTION

This invention relates to components that provide the interface between the combustion section and the inlet of the turbine section of an industrial gas turbine combustion system. More particularly, the invention relates to provision of an improved sealing function about the transition between combustion section and the inlet of the turbine section.

BACKGROUND OF THE INVENTION

A typical industrial gas turbine engine has multiple combustion chambers in a circumferential configuration about the engine shaft. For each combustion chamber there is normally a transition duct, also referred to as a transition piece, through which the hot combustion exhaust flow is carried from each combustion chamber to the inlet of the turbine section. With the plurality of combustion chambers arranged about a central axis of the gas turbine engine, the transition pieces are radially arranged about the turbine axis and comprise outlet ends that converge to form an annular inflow to the turbine inlet. Each transition piece is joined via a sealing arrangement to the turbine inlet section, which is at the front end of the row one vane segment. These and adjoining components experience thermal expansion, thermal stresses and vibrational forces resulting from combustion dynamics, all of which are known to adversely affect performance of numerous components, including the seals. Consequently, numerous seal designs have been proposed to find an improved balance between the seal cost, reliability, durability, installation and repair costs and adverse effects on adjacent components.

One or more turbine vanes mounted between outer and inner curved platforms is called a nozzle. Retainer rings retain a set of nozzles in a circular array for each stage of the turbine. Upper and lower seals on an exit frame of each transition piece seal against respective outer and inner retainer rings of the first stage nozzles to reduce leakage between the combustion and turbine sections of the engine.

Multiple such seals are part of the interface between the exit end of each transition piece and the inlet of the turbine section. Upper and lower seals on an exit frame of each transition piece form part of the sealing structure between the transition piece and the turbine inlet. Also to reduce leakage between the combustion and turbine sections of the engine, additional seals are provided in the interface structure between the exit frame and outer and inner retainer rings of the first stage nozzles. These seals conventionally have sufficient clearance in their slots to accommodate relative dynamic motion and differential thermal expansion between the exit frame and the retainer ring. For this reason, such seals may be called "floating seals". However, such clearance increases gas leakage across the seal, thereby reducing engine efficiency. The initial close tolerances of newly installed floating seals are degraded as a result of wear over the component life. This results in larger gaps through which compressed air enters the hot gas path. This, in turn, is expected to reduce efficiency and may lead to higher emissions of nitrogen-containing by-products.

BRIEF DESCRIPTION OF THE DRAWINGS

The invention is explained in the following description in view of the drawings where.

DETAILED DESCRIPTION OF THE INVENTION

Figure 1:
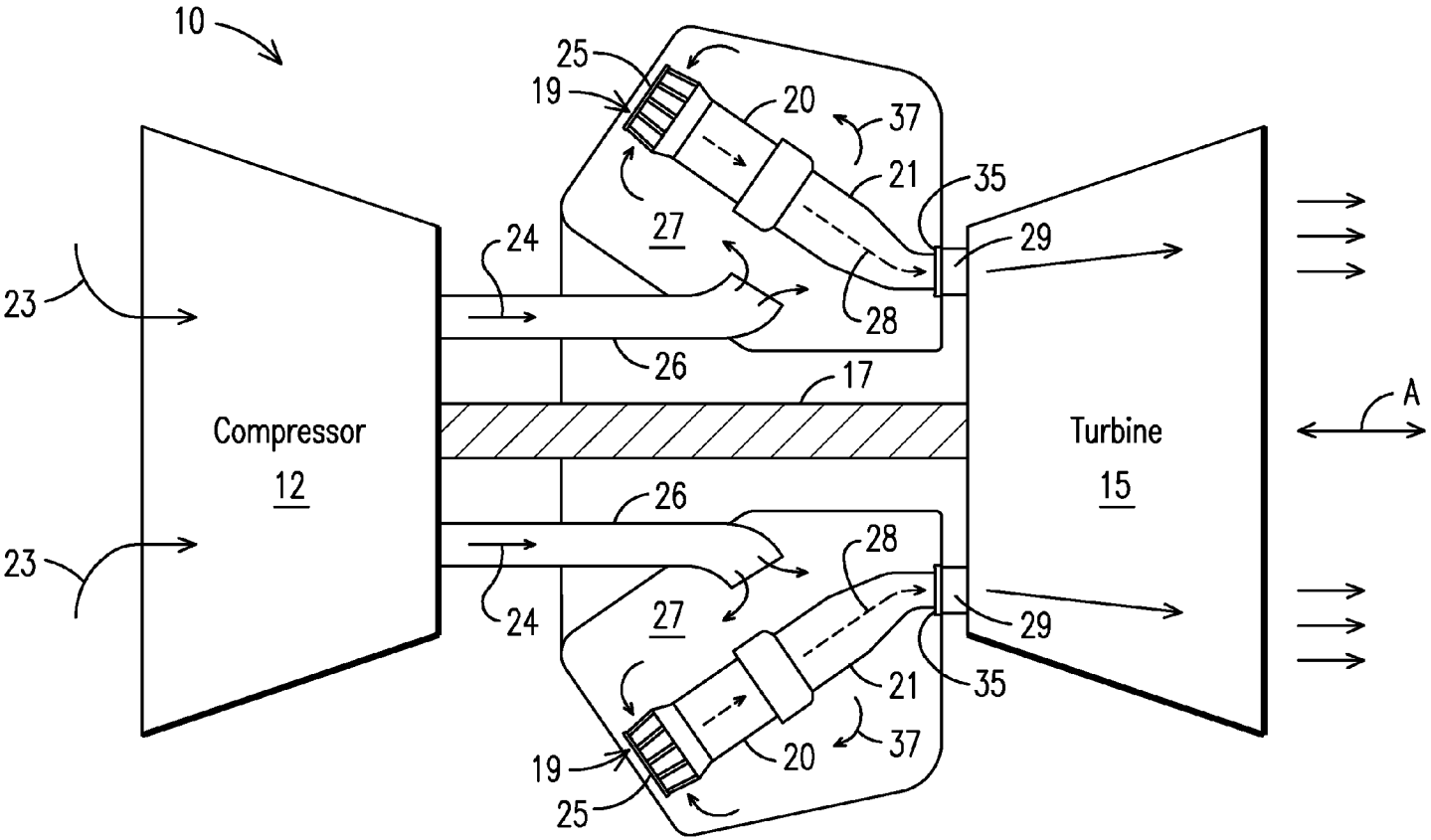
FIG. 1 is a schematic view of an exemplary gas turbine engine within which embodiments of the invention may be employed.

In referencing features and orientations of components shown in the figures, the term radial is used with respect to a central axis, A, about which a rotating machine turns. Even though the component may be illustrated in a figure separate and apart from the rotating machine, it is to be understood that references to positioning, e.g., "radially inner" or "radially outer" correspond to relative positioning as though the component is installed. FIG. 1 is a schematic view of an exemplary gas turbine engine 10 within which embodiments of the invention may be incorporated. The gas turbine engine 10 includes a compressor 12, several combustor assemblies arranged in a circular array in a can-annular design, a turbine section 15, and an engine shaft 17 by which the turbine 15 drives the compressor 12. The combustor assemblies each comprise fuel injectors (not shown) within a cap assembly 19, combustion chambers 20 and transition pieces 21. During operation, the compressor 12 intakes air 23 and provides a flow 24 of compressed air to combustor inlets 25 via a diffuser 26 and a combustor plenum 27. The fuel injectors within the cap assembly 19 mix fuel with the compressed air flow 24. This mixture burns in the combustion chamber 20 producing hot combustion gas, referred to as the working gas 28, that passes through the transition piece 21 to the turbine 15 via a sealed connection comprising inner and outer sealing interfaces. The sealing interfaces are positioned between an exit frame 35 of the transition piece 21 and an inlet section 32 of the turbine 15. The diffuser 26 and the plenum 27 may extend annularly about the engine shaft 17. The compressed air flow 24 entering each combustor plenum 27 has higher pressure than the working gas 28 in the associated combustion chamber 20 and in the transition piece 21.

Figure 2:
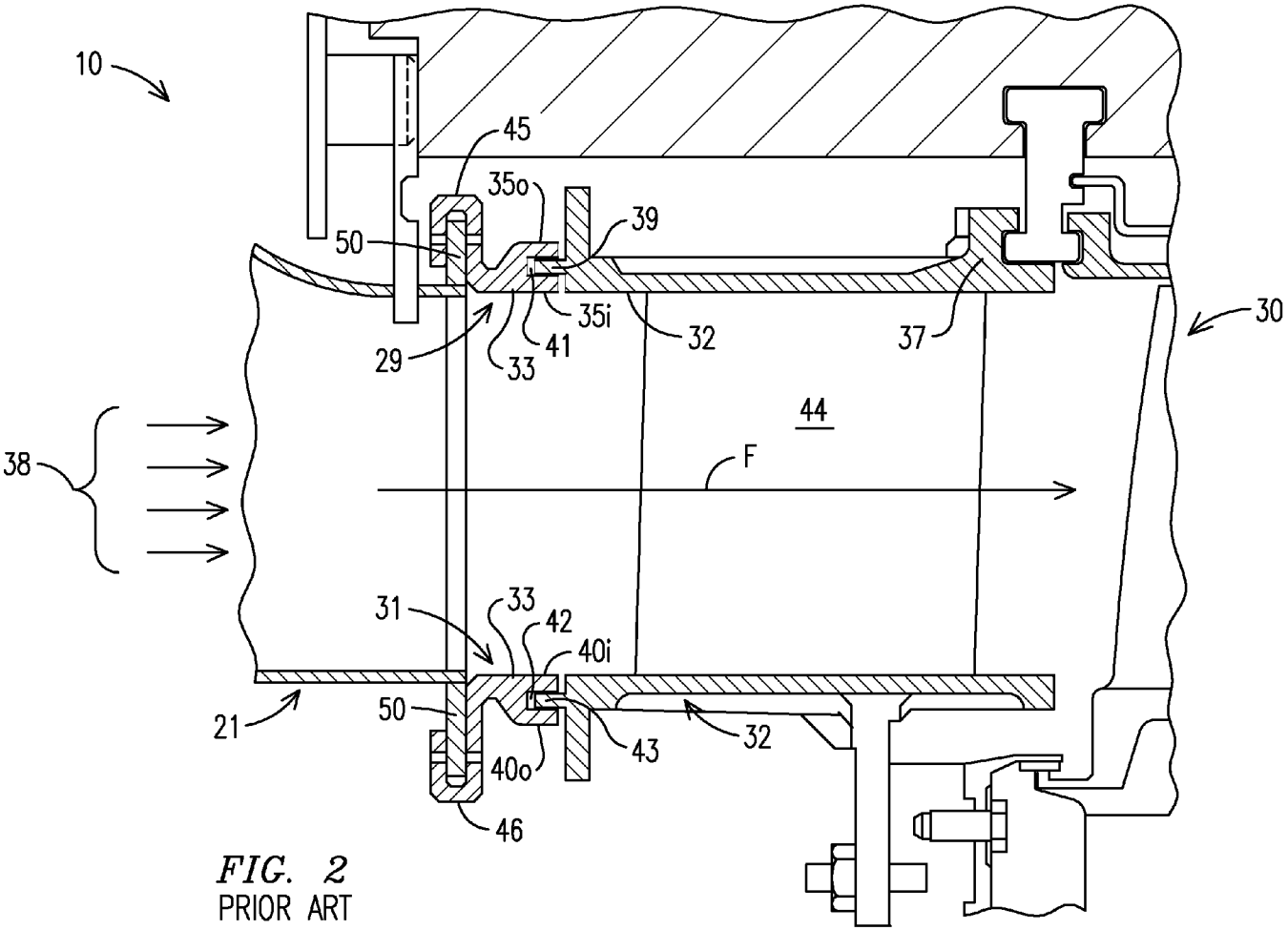
FIG. 2 PRIOR ART
FIG. 2 is a partial view in cross-section of a gas turbine engine, illustrating a typical prior art design of the inner and outer sealing interfaces.

Although embodiments according to the invention will be described in the context of the gas turbine engine 10, prior art features are first described to more clearly present embodiments of the invention. FIG. 2 provides a partial cross-sectional view of the gas turbine engine 10 for an embodiment in which a typical prior art design of the inner and outer sealing interfaces 29 and 31 is employed. Each sealing interface 29, 31 is positioned between a transition piece 21 and an inlet section 32 of the turbine 15. The inlet section 32 is upstream of the Row 1 vane segment 37 (130) which includes exemplary airfoil 38. Relative to the axis, A, of rotation about which the engine shaft 17 rotates, the inner and outer sealing interfaces 29, 31 are referred to as such because the inner sealing interface 29 is a shorter radial distance from the axis, A, than is the radial distance from the outer sealing interface 31 to the axis, A.

The inner sealing interface 29 includes a transition piece inner seal joint 45 and the sealing interface 31 includes a transition piece outer seal joint 46. The seal joints 45, 46 are each of a U-shape design having leg portions which capture a rail 50 extending radially outward and positioned along the downstream portion of the transition piece 21. This mating arrangement effects connection of the transition piece 21 to each of the inner and outer sealing interfaces 29, 31. To couple the transition piece 21 with the inlet section 32 via the sealing interfaces 29 and 31, the sealing interfaces each further comprise a segment 33 extending axially in the downstream direction.

The prior art axial segment 33 of the inner sealing interface 29 is of a U-shape comprising a pair of spaced-apart leg members referred to as an inner (hot) lip 35*i*, and an outer (cold) lip 35*o*. A slot 41 corresponds to the space between the leg members. The terms "inner" and "outer" are used to describe the relative positions of the lips 35*i* and 35*o* with respect to the flow path, F, of the hot combustion gas 38 passing through the transition piece 21 and the turbine 30.

The inner lip 35*i* is relatively close to, or in contact with, the flow path, F, while the outer lip 35*o* is farther away from the flow path than the inner lip 35*i*. The outer lip is shown as positioned along the outer side of the inner sealing interface 29 and outside the flow path. The inner and outer lips 35*i*, 35*o* of the inner sealing interface 29 each extend in the axial direction to engage a radially inner Row 1 vane rail 39 of the inlet section 32 within the slot 41.

The prior art axial segment 33 of the outer sealing interface 31 is also of a U-shape comprising a pair of spaced-apart leg members referred to as an inner (hot) lip 40*i* and an outer (cold) lip 40*o*. A slot 42 corresponds to the space between the inner and outer lips. As described for the lips 35*i* and 35*o*, the terms "inner" and "outer" are used to describe the relative positions of the lips 40*i* and 40*o* with respect to the flow path, F, through the transition piece 21 and the turbine 30. The inner lip 40*i* is relatively close to, or in contact with, the flow path, F, while the outer lip 40*o* is farther away from the flow path than the inner lip 40*i*. The outer lip is shown as positioned along the outer side of the outer sealing interface 31 and outside the flow path. The inner and outer lips 40*i*, 40*o* of the outer sealing interface 31 each extend in the axial direction to engage a radially outer Row 1 vane rail 43 of the inlet section 32, i.e., within the slot 42.

The slots 41 and 42 provide for axial movement and limited radial movement of the inner and outer Row 1 vane rails 39 and 43. In view of the transient and steady state deflections and thermal and dynamic loadings of the mating components (29, 39) and (31, 43), the floating interfaces incur wear. For the sealing interfaces 29 and 31 illustrated in FIGS. 1 and 2, the outer lip 35*o* of the inner sealing interface 29 experiences relatively high levels of vibration, compared to the outer lip 40*o* of the outer sealing interface 31. This is attributable, in part, to the relatively close proximity of the outer lip 35*o* to the turbine rotor. Consequently, the outer lip 35*o* experiences significant wear that can render the seal irreparable. This, in turn, may lead to high costs of replacing the seal as well as high repair costs for the Row 1 vanes. The need to repair and replace components limits the ability to extend the time between inspections of these components.

In describing embodiments of the invention, features of a gas turbine engine common to the afore-described prior art embodiment and embodiments according to the invention are identified with common reference numbers. According to a first embodiment of the invention, an exemplary gas turbine engine 60 and select components providing a sealing function between the transition piece 21 and the turbine inlet section are illustrated in the partial cross sectional views of FIGS. 3A and 3B. The gas turbine engine 60 has several features identical to those described for the gas turbine engine 10 illustrated in FIGS. 1 and 2. However, in lieu of the inner and outer sealing interfaces 29 and 31, the gas turbine engine 60 has an inner sealing interface 61 and an outer sealing interface 63, each comprising a transition seal joint 65. Each of the sealing interfaces 61, 63 is positioned between a transition piece 21 and an inlet section 32 of a turbine 15. Although not shown, it is to be understood that the sealing interfaces 61 and 63 each extend a full 360 degrees along the transition piece 21 and the inlet section 32, to provide a sealing function completely about the flow path, F, of the hot combustion gas 28 traveling into the turbine inlet section 32.

The inlet section 32 is upstream of the Row 1 vane segment 37 which includes exemplary airfoil 44. Relative to the axis, A, of rotation about which the engine shaft 17 rotates, the inner and outer sealing interfaces 61, 63 are referred to as such because the inner sealing interface 61 is a shorter radial distance from the axis, A, than is the radial distance from the outer sealing interface 63 to the axis, A.

Figure 3A:
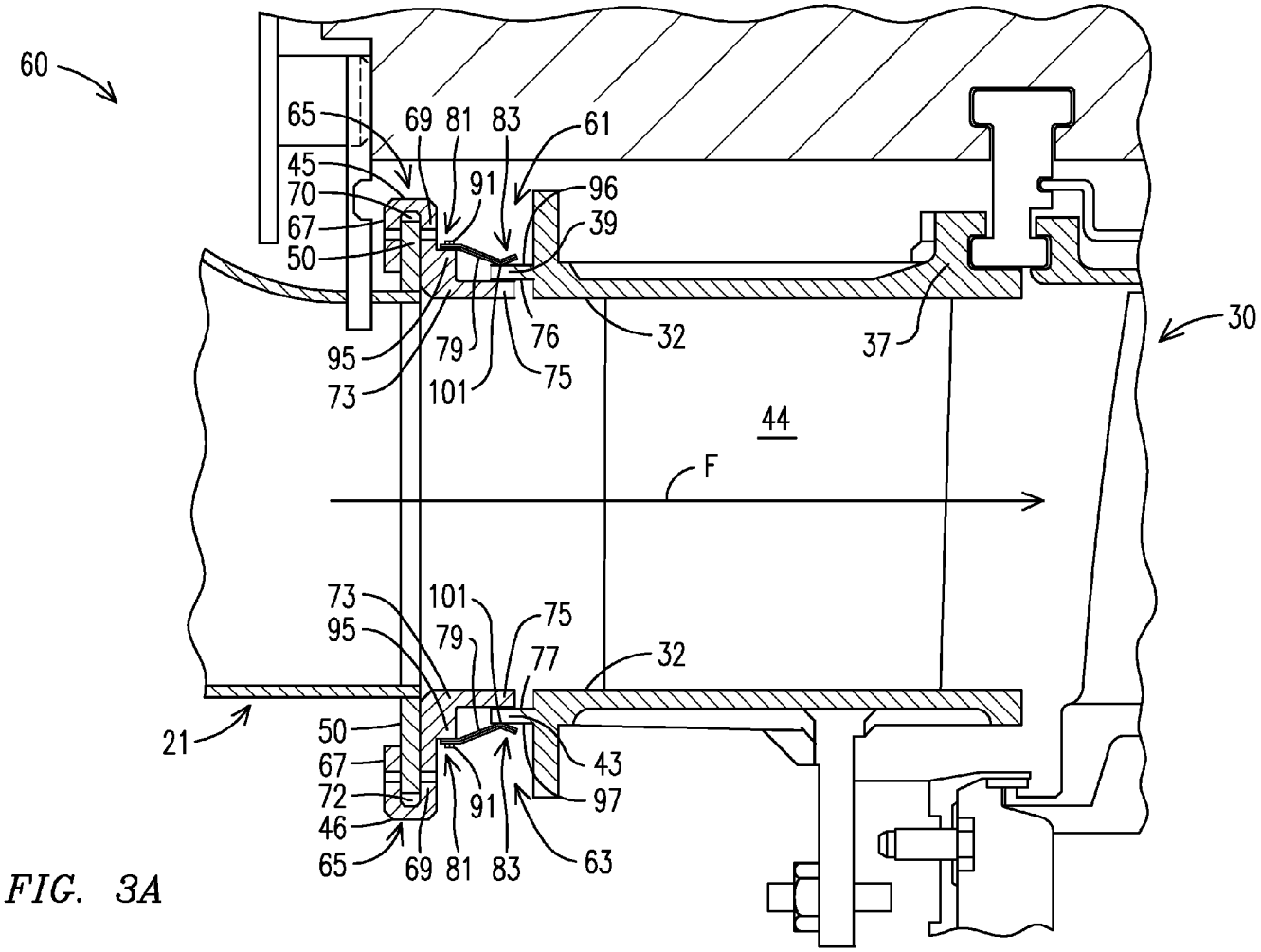
FIGS. 3A and 3B are cross sectional views of an exemplary gas turbine engine illustrating sealing interfaces and a spring seal according to of the invention.

As shown in FIG. 3A, the inner sealing interface 61 may, like the inner sealing interface 29, include a transition piece inner seal joint 45 and the outer sealing interface 63 may, like the outer sealing interface 31, include a transition piece outer seal joint 46. The seal joints 45, 46 are each of a U-shape design having an upstream leg member 67 and a downstream leg member 69 spaced apart from one another to provide slots 70 and 71. The slot 70 corresponds to the space between the leg members 67 and 69 of the inner sealing interface 61, and the slot 72 corresponds to the space between the leg members 67 and 69 of the outer sealing interface 63. The inner seal joint 45 of the inner sealing interface 61 captures within the slot 70 a portion of the transition piece rail 50 extending outward from the flow path, F, which is positioned along the downstream portion of the transition piece 21. Similarly, the outer seal joint 46 of the outer sealing interface 63 captures within the slot 71 a portion of the transition piece rail 50 extending outward from the flow path, F. This mating arrangement between each of the inner and outer seal joints 45, 46 and portions of the transition piece rail 50 effects connection of the transition piece 21 to each of the inner and outer sealing interfaces 61, 63.

In lieu of having a U-shape axial segment 33, in order to couple the transition piece 21 with the inlet section 32 of the turbine 30 via the sealing interfaces 61, 63, each of the sealing interfaces further comprises a segment 73 extending axially in the downstream direction from the downstream leg member 69.

Each axial segment 73 comprises a flange, referred to as an inner lip 75, which extends along either the inner or the outer Row 1 vane rail 39, 43. In each case, the inner lip 75 is positioned along an inner surface 76 of the inner Row 1 vane rail 39 or along an inner surface 77 of the outer Row 1 vane rail 43. That is, the inner lips are in tangential, sliding contact with the inner surface 76 or 77 of one of the rails, as this accommodates limited axial and radial movement of the associated vane rail 39, 43 of the inlet section.

Figure 3B:
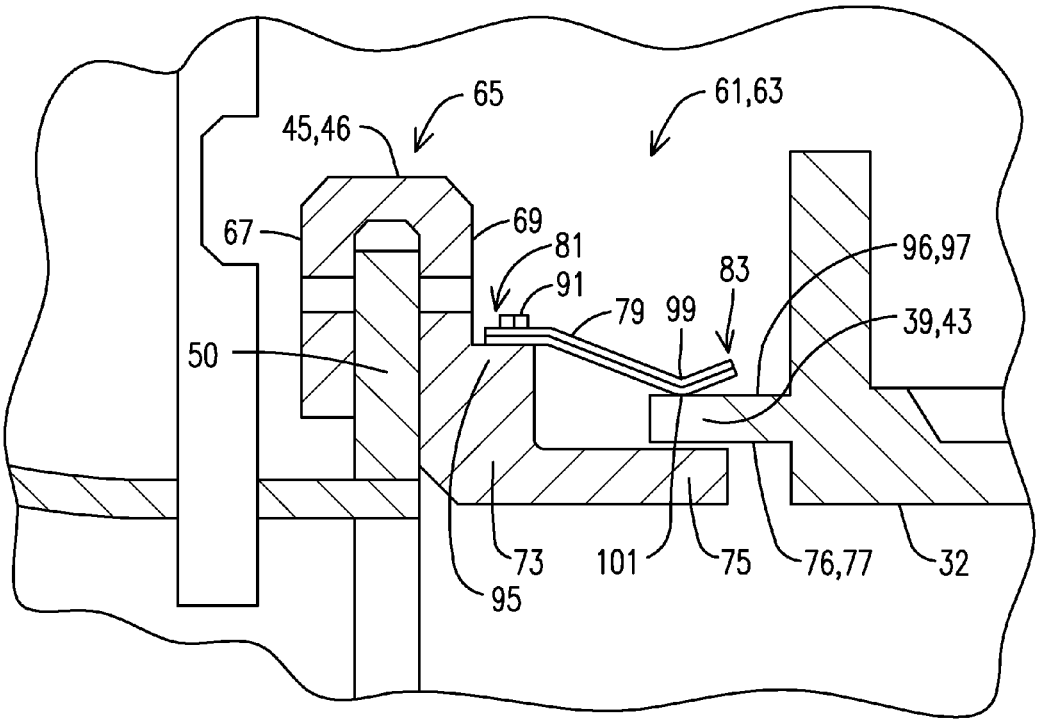

The inner and outer sealing interfaces 61, 63 each further include a spring seal 79 which may be a multi-layer assembly or a laminate structure. Each spring seal has first and second opposing ends 81, 83 and along the first end 81 there are formed a series of apertures 87 (see FIG. 4A) through which fasteners 91 pass to secure the spring seal 79 to the axial segment 73 of the sealing interface. As shown for the embodiment of FIG. 3B, the axial segment 73 may include a shoulder region 95 on which the spring seal 79 is mounted via the fasteners 91. The fasteners 91 may be threaded, with the shoulder region including a series of bores, each having mating threads along surfaces thereof. With each fastener passing through a spring seal aperture 87, the threaded bores each receive the threads formed on one of the fasteners to position the first end 81 of the spring seal 79 against the shoulder region 95. With the spring seals so attached, the second end 83 of each spring seal is a free end which extends to contact an outer surface 96 of the inner Row 1 vane rail 39 or to contact an outer surface 97 of the outer Row 1 vane rail 43. With this positioning the second end 83 of each spring seal 79 elastically flexes to press against one of the outer surfaces 96, 97 of a vane rail 39, 43. As illustrated in FIG. 3B, the second end 83 of each spring seal 79 also includes a bend that forms a ridge or bead 99 along at least a portion of the region that extends along the outer surface 96, 97. As each seal 79 flexes against one of the surfaces 96, 97 sealing contact is maintained along a line of contact 101 between surfaces of the seal 79 and a surface 96 or 97.

The spring seal 79 could be a simple, flexible plate which can be affixed to the axial segment 79 or generally to the transition seal joint 65, e.g., to a downstream leg member 69. Further, the function provided by the spring seal in combination with an axial segment, e.g., the segment 73, can be provided without the transition seal joint 65 or separate and apart from a transition seal joint 65, e.g., as discrete components. In these and other embodiments the spring seal 79 could be a multi-layer structure. An example of such a spring seal structure is illustrated in the partial view of a finger seal assembly 98 shown in FIGS. 4A-4C. As for other embodiments of the spring seal 79, the finger seal assembly 98 extends 360 degrees along the transition piece 21 and also along the vane rails 39 and 43 of the inlet section 32. The assembly comprises a plurality of finger seal plates positioned against one another to inhibit leakage between high pressure and low pressure regions while providing flexibility in the seal. The illustrated embodiment includes first and second seal plates 110, 112 of substantially the same size, each positioned against the other to provide a segment of a 360 degree arc, e.g., 22.5 degrees which contacts one of the rails 39, 43. Each plate includes the aforementioned bead 99 extending circumferentially along the second end 83 so that when the assembly is installed as a spring seal 79 the bead 99 extends along the outer surface 96 or 97 of a vane rail 39 or 43. Each plate also includes a series of metered holes 100 aligned with metered holes formed in the other plate so that, when each plate 110, 112 is positioned against the other, co-aligned pairs of holes 100 allow a controlled flow through the plates.

Figure 4C:
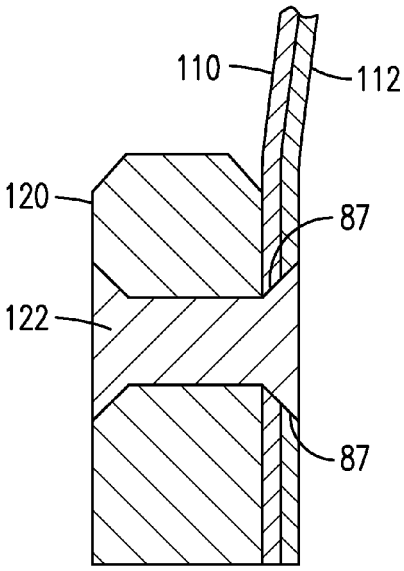
FIG. 4C is a view in cross section of a portion of the segment shown in FIG. 4A, illustrating a fastener connecting a backing ring segment to the seal plates shown in FIGS. 4A and 4B.
Figure 4A:
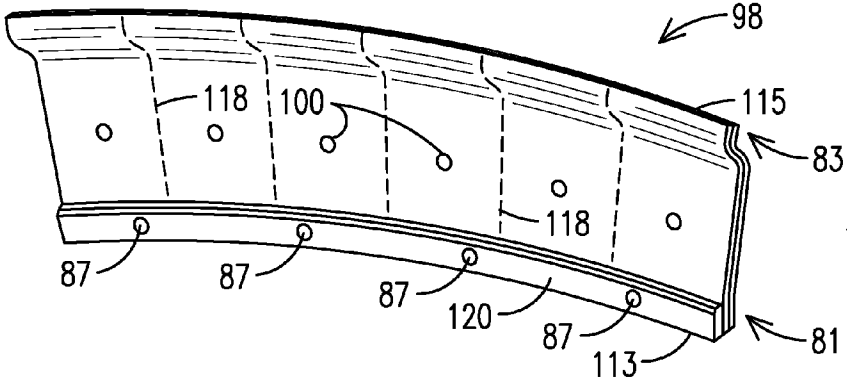
FIG. 4A is a partial perspective view of a finger seal assembly illustrating a segment thereof comprising a backing ring and seal plates.
Figure 4B:
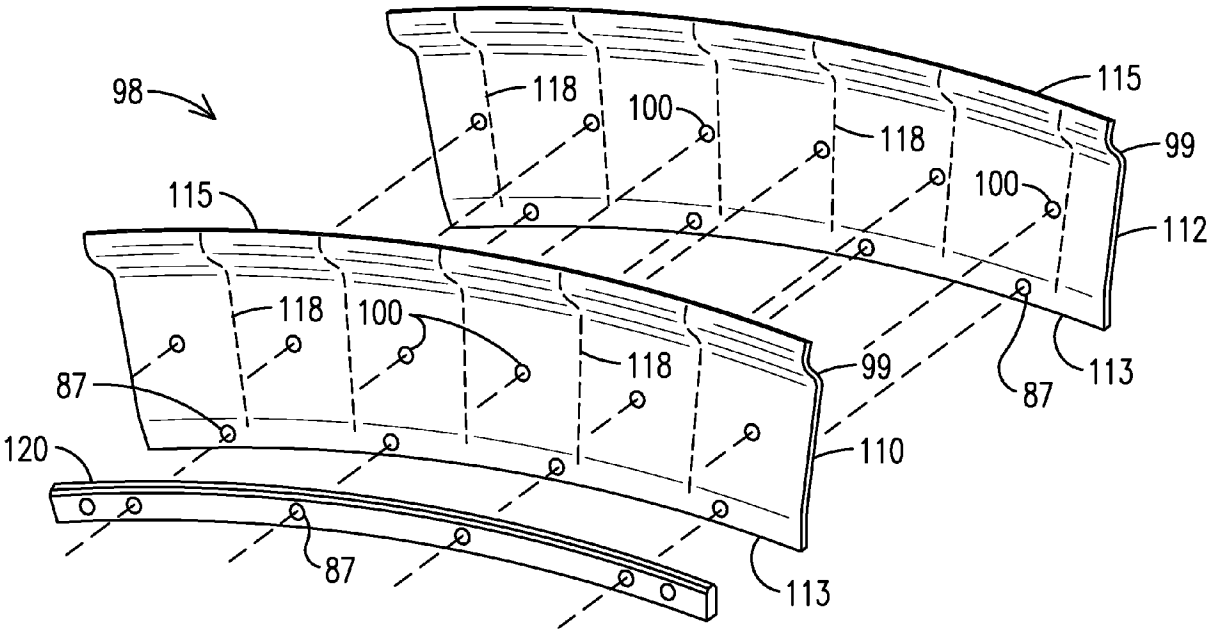
FIG. 4B is an exploded view of the segment of the finger seal assembly shown in FIG. 4A.

With reference to FIG. 4B, each plate 110, 112 includes a series of partial cuts 118 (indicated by dash lines) extending from near a radially inner edge 113 along the first end 81 of the assembled spring seal to a radially outer edge 115 along the second end 83 of the assembled spring seal to provide flexibility to the plate. The angular positions of the cuts 118 of the plate 112 (about the axis, A) are staggered with respect to the angular positions of the cuts 118 of the plate 110 so that, when the plates are each positioned one against the other to provide a segment of a 360 degree arc, the cuts 118 do not coincide. This staggered arrangement permits use of cuts to provide flexibility of each plate while limiting leakage between high pressure and low pressure regions.

The plates 110, 112 are fixedly assembled against one another with a backing ring segment 120 subtending the entire segment of the arc. The backing ring segment 120 is positioned along the radially inner edge 113 and may be fastened with a series of rivets 122 that pass through a corresponding series of apertures 122 formed through each of the plates 110 and 112 as illustrated in FIG. 4C.

Figure 5A:
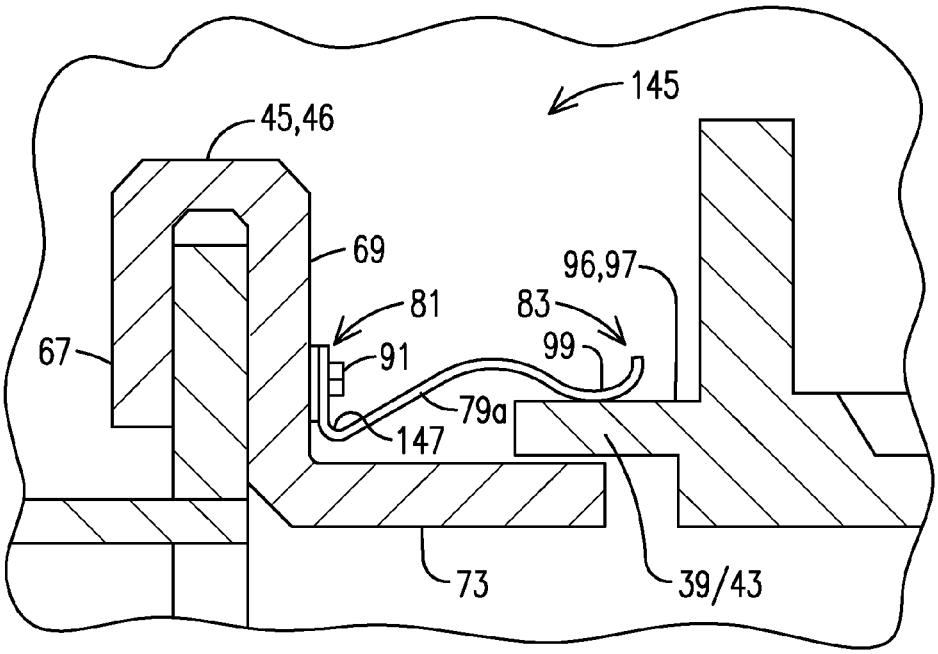
FIGS. 5A and 5B are views in cross section illustrating alternate embodiments of spring seals according to the invention.

Examples of a sealing interface, an associated axial segment and a spring seal have been described. Numerous other designs for the axial segment and for attachment of the spring seal are within the scope of the invention. For example, FIG. 5A illustrates a sealing interface 145 with a spring seal 79*a* similar to the spring seal 79 but configured to have points of attachment on the downstream leg 69 of a seal joint 45, 46, adjacent the axial segment 73. The illustrated spring seal 79*a* may be constructed substantially in accord with the embodiment shown in FIGS. 4 except that (i) the portion of each plate along the first end includes a bend 147 to effect mounting of the spring seal on the downstream leg 69 while permitting the second end 83 to extend over the outer surface 96 or 97 of a vane rail 39 or 43; and (ii) a portion of each plate, between the first end 81 and the bead 99 includes a curve which enhances the force applied to the associated vane rail 39 or 43.

Figure 5B:
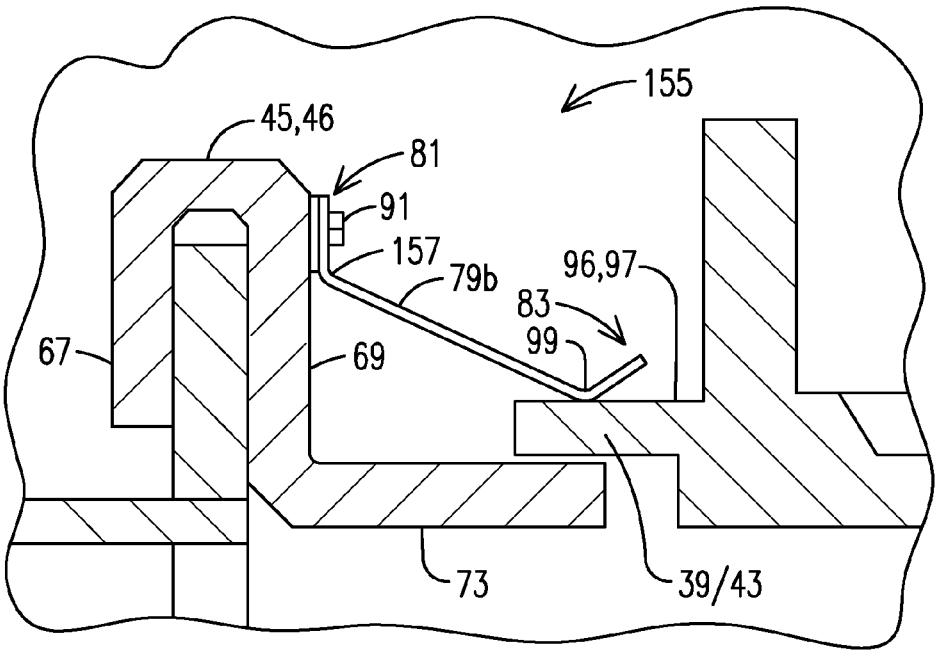

FIG. 5B illustrates another sealing interface 155 having a spring seal 79*b* similar to the spring seals 79 and 79*a*, and also having points of attachment on the downstream leg 69 of a seal joint 45, 46, but with the points of attachment spaced a substantial or a maximum distance away from the axial segment 73. The illustrated spring seal 79*b* also may be constructed substantially in accord with the embodiment shown in FIGS. 4 except that the portion of each plate along the first end includes a bend 157 to effect mounting of the first end 81 of the spring seal on the downstream leg 69 while permitting the second end 83 to extend over the outer surface 96 or 97 of a vane rail 39 or 43.

Embodiments of a sealing connection component have been illustrated. The component may be positioned along an interface between an exhaust gas transition section and an inlet section of a turbine rotatable about a central axis. With the transition section including a rail which extends circumferentially about the axis, and the turbine inlet section may include a turbine flange extending circumferentially about the axis and extending upstream in an axial direction toward the transition section for contact with the sealing connection component when the sealing connection component is positioned at the interface. With the turbine flange having inner and outer opposing surfaces, the inner surface faces the axis and the outer surface faces away from the axis. The sealing connection component includes a U-shaped component, a seal flange portion and a flexible strip.

The U-shaped section includes first and second leg portions extending in a common direction so that, when the sealing connection component is positioned at the interface, each leg extends toward the axis and along a different side of the rail. The first and second legs also extend circumferentially about the axis. The seal flange portion is connected to the U-shaped section and these may be formed as a unitary body. When the sealing connection component is positioned at the interface, the U-shaped section (i) extends circumferentially about the axis with the second leg and (ii) extends in a direction away from the first leg with a surface of the seal flange portion facing the inner surface of the turbine flange, thereby stabilizing the sealing connection component with respect to the rail.

The flexible strip extends circumferentially along with the seal flange portion and is positioned radially outward with respect to the seal flange portion of the U-shaped section. Noting that each leg is positioned along or against a different side of the rail, the flexible strip also extends in a direction along the axis between the U-shaped section and the turbine flange to act as a spring member pressing against the outer surface of the turbine flange. When the sealing connection component is installed at the interface between the transition section and the inlet piece of a turbine section, the combination of the U-shaped section and the flexible strip provide a seal about a volume extending from the axis to the installed U-shaped section.

In the afore-described embodiment, the transition section includes a plurality of transition pieces each connected to channel exhaust gas flow from a combustion chamber to the turbine section. Each transition piece includes an upstream end providing connection to the combustion chamber and a downstream end adjoining the inlet piece of the turbine section. The downstream end including a transition exit frame for connection to the sealing connection, wherein the rail extends along a span of one or more transition exit frames. When the sealing connection component is installed at the interface between the transition section and the turbine inlet section, the combination of the U-shaped section and the flexible strip provide a seal about a volume extending from the axis to the installed U-shaped section.

Also in accord with the illustrated embodiments, a transition seal assembly has been described for a gas turbine engine. Exhaust gas generated in a combustion chamber flows along the transition seal assembly and toward the engine turbine. The assembly has first and second opposing ends with a U-shape body member (e.g., seal joint 45 or 46) at the first end and a seal flange (e.g., flange 75) extending along the second end of the assembly. The transition seal assembly is positionable between a transition section downstream of the combustion chamber and an inlet flange attached to an inlet section of the turbine, where the inlet flange is understood to extend circumferentially about the axis of rotation of the turbine. The seal flange extends away from the first end of the assembly and along an axial direction defined by the turbine axis of rotation. A flexible member (e.g., spring seal 79) is affixed to the body member and extending along the seal flange so that, when the transition seal assembly is positioned between the transition section and the flange of the inlet section, the flexible member is positioned radially outward from the seal flange with the flexible member making contact with the flange of the turbine inlet section.

With the transition seal assembly installed between the transition section and the turbine inlet section, the U-shaped body member extends circumferentially about the turbine axis. The U-shaped body member comprises a pair of parallel portions that fit about a rail surface of the transition section. The rail surface extends radially outward with respect to the axis and extends circumferentially about the axis to effect connection between the transition seal assembly and the transition member.

The spring seal may comprise two or more finger seal plates positioned against one another to inhibit leakage when placed between high pressure and low pressure regions of the engine. The described plates form a segment of an arc for positioning about the axis, it being understood that there may be a series of such segments positioned about the axis to extend the arc 360 degrees. The finger seal plates may each include a series of cuts or gaps arranged so that when, the plates are positioned against one another to inhibit leakage, the positions of the gaps on each plate are staggered with respect to the relative positions of the gaps on the other plate.

While several embodiments of the present invention have been shown and described herein, such embodiments are provided by way of example only. Numerous variations, changes and substitutions may be made without departing from the invention herein. Accordingly, it is intended that the invention be limited only by the spirit and scope of the appended claims.

The claimed invention is:

1. A transition seal assembly for a gas turbine engine, along which exhaust gas generated in a combustion chamber can flow toward a turbine of the gas turbine engine, the transition seal assembly comprising:

first and second opposing ends with a U-shape body member at the a first end and a seal flange extending along a second end, the transition seal assembly positionable between a transition section downstream of the combustion chamber and an inlet flange attached to an inlet section of the turbine, wherein the inlet flange extends circumferentially about an axis of rotation of the turbine, the seal flange extending away from the first end and along an axial direction defined by the axis of rotation; and a flexible member affixed to the transition seal assembly and extending along the seal flange so that, when the transition seal assembly is positioned between the transition section and the inlet flange of the inlet section, the flexible member is positioned radially outward from the seal flange with the flexible member comprising a bend making contact with the inlet flange of the turbine inlet section, wherein the inlet flange has an inner surface and an outer surface opposite to the inner surface with the inner surface facing a flow path of the exhaust gas between the transition section and the inlet section and the outer surface faces away from the flow path, and wherein the flexible member is a spring seal including a first end attached to the transition seal assembly and a second end opposite to the first end, wherein the second end comprises the bend and wherein the bend comprises a bead configured to elastically press on the outer surface of the inlet flange such that sealing contact is maintained along a line of contact between the bead and the outer surface of the inlet flange.

2. The transition seal assembly of claim 1 wherein, with the transition seal assembly installed between the transition section and the inlet section, the U-shaped body member extends circumferentially about the axis of rotation, and the U-shape body member comprises a pair of parallel portions that fit about a rail surface of the transition section, wherein the rail surface extends radially outward with respect to a flow path of the exhaust gas between the transition section and the inlet section and extends circumferentially about the axis of rotation to effect connection between the transition seal assembly and the transition section.

3. The transition seal assembly of claim 1 wherein the spring seal comprises first and second finger seal plates positioned against one another to inhibit leakage when placed between high pressure and low pressure regions, the first and second finger seal plates forming a segment of an arc for positioning about the axis of rotation.

4. The transition seal assembly of claim 3 wherein each finger seal plate includes a series of partial cuts arranged so that, when the first and second finger seal plates are positioned against one another to inhibit leakage, the series of partial cuts on one of the first and second finger seal plates are staggered with respect to the series of partial cuts on the other of the first and second finger seal plates.

5. The transition seal assembly of claim 4, wherein the first and second finger seal plates each comprise a series of metered holes, wherein the series of metered holes of the first and second finger seal plates are aligned to allow a controlled flow of air through the first and second finger seal plates.

6. The transition seal assembly of claim 4 wherein a backing ring segment is fastened to a radially inner edge of each of the first and second finger seal plates with a series of rivets.

7. The transition seal assembly of claim 1 wherein the first end includes a plurality of apertures and wherein a plurality of fasteners are passed through the plurality of apertures to secure the first end to the transition seal assembly.

8. The transition seal assembly of claim 1 wherein the U-shape body member includes an upstream leg member and a downstream leg member, wherein the upstream leg member and the downstream leg member form a slot to receive a rail surface of the transition section, and wherein the first end is attached to the downstream leg member.

9. The transition seal assembly of claim 8 wherein the first end is attached to a portion of the downstream leg member adjacent to a junction of the downstream leg member and the seal flange such that the first end comprises a bend opposite to the bend in the second end.

10. The transition seal assembly of claim 9 wherein the spring seal comprises a curve in a region between the bend at the first end and the bend at the second end.

11. The transition seal assembly of claim 8 wherein the first end is attached to a portion of the downstream leg member at a maximum distance away from the seal flange such that the first end comprises a bend opposite to the bend in the second end.

12. The transition seal assembly of claim 1 wherein the U-shape body member includes an upstream leg member and a downstream leg member, wherein the upstream leg member and the downstream leg member form a slot to receive a rail surface of the transition section, wherein the transition seal assembly further comprises an axial segment extending axially in a downstream direction from the downstream leg member to the seal flange, wherein the axial segment has a greater thickness than the seal flange, and wherein the flexible member is affixed to the axial segment.

13. A sealing connection component for an interface between a transition section and an inlet section of a turbine of a gas turbine engine, comprising:

a U-shaped section including first and second leg portions such that when the sealing connection component is positioned at the interface, each leg extends along a different side of a rail of the transition section;

a seal flange portion connected to the U-shaped section such that when the sealing connection component is positioned at the interface, the seal flange portion extends in an axial direction away from the first and second leg portions and a surface of the seal flange portion is in sliding contact with an inner surface of the inlet section of the turbine; and a flexible strip positioned radially outward with respect to the seal flange portion such that the flexible strip comprises a bend that makes contact with an outer surface of the inlet section of the turbine opposite to the inner surface of the inlet section of the turbine.

14. The sealing connection component of claim 13 wherein the inner surface of the inlet section faces a flow path of exhaust gas across the interface, wherein the flexible strip is a spring seal including a first end attached to the sealing connection component and a second end opposite to the first end, wherein the second end comprises the bend.

15. The sealing connection component of claim 13 wherein the bend comprises a bead configured to elastically press on the outer surface of the inlet section such that sealing contact is maintained along a line of contact between the bead and the outer surface of the inlet flange.

16. The sealing connection component of claim 13 wherein the flexible strip is a spring seal comprising first and second finger seal plates positioned against one another to inhibit leakage when placed between high pressure and low pressure regions, wherein each finger seal plate includes a series of partial cuts arranged so that, when the first and second finger seal plates are positioned against one another to inhibit leakage, the series of partial cuts on one of the first and second finger seal plates are staggered with respect to the series of partial cuts on the other of the first and second finger seal plates.

* * * * *